US005989204A

United States Patent [19]

Lina

[11] Patent Number: 5,989,204

[45] Date of Patent: Nov. 23, 1999

[54] FOOT-MOUNTED VENOUS COMPRESSION DEVICE

[75] Inventor: Cesar Z. Lina, San Antonio, Tex.

[73] Assignee: Kinetic Concepts, Inc., San Antonio, Tex.

[21] Appl. No.: 08/816,807

[22] Filed: Mar. 19, 1997

Related U.S. Application Data

[63] Continuation of application No. 08/428,268, Apr. 25, 1995, abandoned, which is a continuation of application No. 08/275,920, Jul. 14, 1994, abandoned, which is a continuation of application No. 08/000,545, Jan. 4, 1993, abandoned, which is a continuation of application No. 07/766, 576, Sep. 27, 1991, abandoned.

[51] Int. Cl.[6] ..... A61H 7/00

[52] U.S. Cl. ..... 601/152; 601/151; 601/149; 601/148

[58] Field of Search ..... 601/148, 149, 601/150, 151, 152

[56] References Cited

U.S. PATENT DOCUMENTS

| | | | |
|---|---|---|---|
| 1,304,915 | 5/1919 | Spinney | 36/153 |
| 1,492,514 | 4/1924 | Jensen . | |
| 2,708,930 | 5/1955 | Lowman | 602/27 |

(List continued on next page.)

FOREIGN PATENT DOCUMENTS

| | | |
|---|---|---|
| 0039629 | 11/1981 | European Pat. Off. . |
| 0514204A1 | 11/1992 | European Pat. Off. . |
| 837750 | 8/1951 | Germany . |
| 77-14667 | 5/1977 | Germany . |
| 635094 | 9/1986 | Germany . |
| 47-10392 | 10/1972 | Japan . |
| 48-20636 | 3/1973 | Japan . |
| 52142889 | 11/1977 | Japan . |
| 2168234 | 6/1986 | United Kingdom . |

OTHER PUBLICATIONS

Bradley, JOhn G. et al., The Use of Intermittent Plantar Venous Impulse Compression to Reduce Post–Operative Deep Venous Thrombosis, on or about Feb. 18, 1991.

"EBI Venous Pump System" 2000, Test Report, BSI Testing Services, Jul. 21, 1986.

Kakkar, V.V. and N.V. Wilson, An Evaluation of the A–VI Foot Pump as Prophylaxis Against VEnous Thromboembolism in Total Knee Replacement, Publication data unknown.

Koslow, Alan R. et al., "The Foot Pump An Anatomic and Physiological Study of the Plantar Venous Plexus," Uknown.

McMullin, G.M. et al., "Comparison of Calf and Foot Venous Pumps in Patients with Cronic Venous Insufficiency," Unknown.

Morgan, R.H. et al., Increased Popliteal Arterial Blood Flow During Intermittent Impulse Compression of the Foot in Normal Subjects and in Patients with Vascular Disease, Unknown.

Rastgeldi, Selahaddin, Intermittent Pressure Treatment of Peripheral Vascular Diseases, (1972) 19–29.

Styf, J., "The Venous Pump of the Human Foot," Clinical Physiology, vol. 10 (1990) 77–84.

Thesis by James C. W. Parrott, entitled The Effect of a Mechanical Venous Pump on the Circulation in the Feet in the Presence of Arterial Obstruction, Oct. 1972.

(List continued on next page.)

*Primary Examiner*—Richard J. Apley
*Assistant Examiner*—Benjamin K. Koo
*Attorney, Agent, or Firm*—Wayne J. Colton, Inc.

[57] ABSTRACT

A medical device having an expandable fluid-tight bladder formed integral within a wrap (or sheath) that can be securely fastened onto a human foot. The foot wrap positions and holds the bladder under the arch of the foot so as to compress the sole area when the bladder is inflated. The foot wrap is soft, lightweight, flexible and suitable for extended wear with minimum discomfort. It can be readily used with a pneumatic or hydraulic pressure applicator or cyclic pump to promote blood circulation in the legs of bedridden patients.

4 Claims, 2 Drawing Sheets

U.S. PATENT DOCUMENTS

| | | | |
|---|---|---|---|
| 3,303,841 | 2/1967 | Dennis . | |
| 3,391,692 | 7/1968 | Spielberg . | |
| 3,654,919 | 4/1972 | Birtwell . | |
| 3,773,036 | 11/1973 | Weyer | 128/686 |
| 3,993,053 | 11/1976 | Grossan . | |
| 4,033,337 | 7/1977 | Raczkowski | 128/686 |
| 4,054,129 | 10/1977 | Byars et al. . | |
| 4,077,402 | 3/1978 | Benjamin, Jr. . | |
| 4,314,412 | 2/1982 | Anderson | 36/100 |
| 4,343,302 | 8/1982 | Dillon . | |
| 4,413,620 | 11/1983 | Tucker . | |
| 4,419,988 | 12/1983 | Mummert . | |
| 4,590,925 | 5/1986 | Dillion . | |
| 4,696,289 | 9/1987 | Gardner | 128/40 |
| 4,738,249 | 4/1988 | Linman et al. . | |
| 4,747,398 | 5/1988 | Wright . | |
| 4,753,226 | 6/1988 | Zheng et al. . | |
| 4,773,170 | 9/1988 | Moore | 36/110 |
| 4,809,684 | 3/1989 | Gardner et al. . | |
| 4,832,010 | 5/1989 | Lerman | 602/65 |
| 4,865,020 | 9/1989 | Bullard . | |
| 4,971,044 | 11/1990 | Dye | 128/24 R |
| 5,052,128 | 10/1991 | Lonardo | 602/23 |
| 5,113,877 | 5/1992 | Johnson | 128/869 |
| 5,176,624 | 1/1993 | Kuehnreich | 602/65 |
| 5,354,260 | 10/1994 | Cook | 601/149 |

OTHER PUBLICATIONS

Collard, J.J. et al "Action De La Pompe Veineuse Du Pied Chez Des Patients Atteints D'Acro–Angiodermatitis", Phlebologie, 31(3), 249–256 (1978).

Anonymous, "Physical methods of prophylaxis against venous thrombosis", British Medical Journal, 282, 1241–1342 (1981).

Binnis M. et al, "Anatomy of the 'venous foot pump", Injury 19, 443–445 (1988).

Gardner, A.M.N. et al, The Return of Blood To The Heart venous pumps in health and disease, John Libbey & Company Ltd.

Fox, R.H. and G rdner, A.M.N., "P antar Venous Pump", Injury 21, 129–130 (1990).

FOOT-MOUNTED VENOUS COMPRESSION DEVICE

This application is a continuation of application Ser. No. 08/248,268 filed Apr. 25, 1995, now abandoned, which is a continuation of application Ser. No. 08,275,920 filed Jul. 14, 1994, now abandoned, which is a continuation of application Ser. No. 08/000,545 filed Jan. 4, 1993, now abandoned, which is a continuation of application Ser. No. 07/766,576 filed Sep. 27, 1991, now abandoned.

BACKGROUND OF THE INVENTION

1. Field of the Invention

The present invention relates to message devices which apply pressure to the body. More particularly, the invention is in the class of medical devices which utilize cyclic pressure to aid blood circulation in the limbs of a human body.

2. Related Art

Medical devices that apply cyclic pressure to a person's legs, arms and/or feet are very old and well-known in the art. Many have employed pulsating pads or plungers for improving circulation. Others have used hydraulic and pneumatic bladders for the same and for many other purposes. The shapes, sizes, and composition of such bladders and pads are widely varied, depending largely on their particular application.

Man has known the fundamental principle of most cyclic compression devices for thousands of years. They are merely a more recent embodiment of the old art of massage, which has been used to stimulate circulation since prehistory. Use of mechanical devices to effect the massaging action is obviously more recent, but has a clear history of more than 150 years.

Full understanding of the mechanism involved in this form of improving blood flow is more recent but has not fundamentally changed the devices used to accomplish this result. Veins are now known to contain a series of one-way check valves along their length. Thus, when pressure is applied, compressing a vein, the fluid expelled therefrom can only proceed in the direction of normal circulation. When such compression is relaxed, the vein returns to its normal circular cross-section, and the flow of blood into the vein is increased until it reaches its normal state of back pressure. Repeating this cycle in a cyclic fashion thus increases blood flow in the normal direction of circulation.

Such compression/decompression cycles occur naturally in humans as part of the action of the muscles and flexure of the limbs. It has been known for many years that the arch of the foot includes a large venous plexus (or group of veins). It is also known that this venous plexus is compressed during normal walking or running, thereby stimulating circulation. This efficient circulation aid is a marvelous design by our Creator, as its effect is greatest when the leg muscles (the largest muscles in the body) are in action and need the oxygen supplied by enhanced circulation.

For these and other reasons, the foot has long been known as an effective site for applying cyclic pressure. For instance, many devices such as Massator's "PediPulsor" improve circulation by positioning a pulsating, dome-shaped pad in the arch of the foot. Many others have targeted the arch of the foot with flexible pneumatic chambers. A partial sampling of such pneumatic devices that target the arch of the foot includes Japanese Utility Model No. 72-10392, U.S. Pat. No. 4,941,458 in the name of Taheri.

Many others have long recognized that the foot contains veins that can be massaged or pumped to provide better circulation. Some examples are: L. E. Corcoran, who states in his U.S. Patent of Apr. 7, 1959 that massaging the soles of the feet "promotes a beneficial degree of circulation"; Richard Dillon M.D. whose *Journal of Vascular Diseases*, January 1986 report on treatment of circulation-impaired patients states "compression boot therapy enjoys a 173 year history;" and P. Gaskell M.D. and J. C. W. Parrot M.D. whose *Surgery, Gynecology, and Obstetrics*, April 1978 report shows a high level of understanding of the process of venous pumping with pulsed air by stating "We have found that the boot covering the foot alone is simpler, less cumbersome, and gives a greater reduction of venous pressure than either a large cuff which covers the whole calf or a boot which includes the calf and the foot."

Further background and many other related references are known to those of skill in this art, and pertinent examples of those references will be provided to the United States Patent Office under separate cover.

SUMMARY OF THE INVENTION

The present invention is directed toward improving upon the teachings of the prior art, uniquely integrating various concepts and features to provide a significant advancement in the field. A primary object of the invention is to provide a small, lightweight and comfortable device, preferably suitable for prolonged wear, which helps prevent and/or solve many of the problems associated with impaired circulation.

Another object includes providing a pneumatic device which encloses only limited portions of the foot, especially those portions which may be readily compressed to improve circulation. Related objects include providing comfort and moisture control and avoiding the need for accessories such as additional stockings, wraps, sandals, straps, and the like, which have been required by the prior art.

Another object of the present invention is to provide as intermittant compression device requiring a minimum volume of air per pulsation.

Another object is to provide a blood circulation aid which will fit a wide variety of patients without requiring any modifications or adjustments.

Another object is to provide a device of great simplicity and ease-of-use in contrast to other devices designed for the purpose of siding blood flow in the feet and legs.

Another object of the invention is to provide a blood flow improvement device which, due to its inherent low manufacturing cost, is practical to use as a disposable item rather than cleaning and reusing.

The present invention addresses the foregoing and many other objects by providing an ingenious article that integrates a compression bladder and its entire mounting, stabilizing and adjustment systems into a simple and economical construction.

The present invention comprises a foot wrap device made from two sheets of fabric sewn or welded together to form an inflatable pocket or bladder in part of the main body area. One aspect of the invention relates to its roughly T-shaped configuration, with at least one extension from the main body area for encompassing the foot's arch. A second extension preferably extends from the main body in a direction opposite the first. A third extension from the main body is roughly perpendicular to the arch-encompassing extensions, for embracing the back of the heel. In the preferred embodiment, both inner and outer fabric layers are cut from the same pattern.

Fasteners formed integral with two of the extensions enable releasable application on the foot. Preferably, outer surface of the foot wrap is formed of Velcro loop material (or the equivalent) for mating with the hooked fasteners. The inner layer of the foot wrap is a vapor permeable material having greater elasticity than the outer layer. Both fabrics are preferably impermeable to air and capable of being fused together by heat welding. A filling tube is sealed into said inflatable bladder through the outer fabric layer.

In the preferred embodiment, the complete foot wrap weighs only a few ounces and is soft and pliable. When the device is properly applied, the inflatable bladder lies under the arch of the foot. One extension wraps over the instep to completely surround the foot and fastens to the outside surface of the main body section, thus securely holding the device in place on the foot to hold the bladder in place when it is inflated. Fluid for such extension is supplied in a pulsed sequence selected for frequency and intensity by the physician from one of the pump/control systems well known in the art.

Numerous other features, advantages, and objects of the invention will evident from the following more detailed description of certain preferred embodiments, particularly when considered together with the accompanying drawings and appended claims.

DETAILED DESCRIPTION OF THE PREFERRED EMBODIMENT

Figure 1:
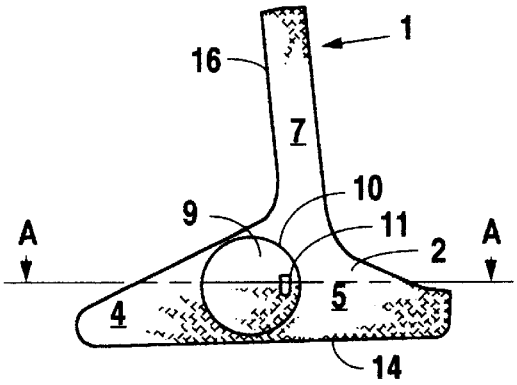
FIG. 1 shows a first embodiment of the present invention in the form of a foot wrap 1, particularly showing the outer surface of the foot wrap as it is laid out flat.
Figure 2:
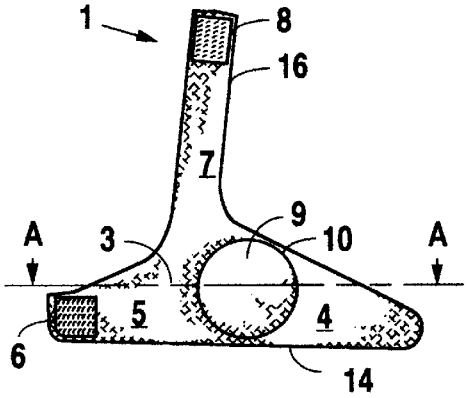
FIG. 2 shows a view of the inner surface of the foot wrap 1 laid flat.
Figure 3:
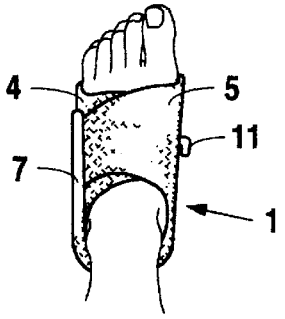
FIG. 3 shows a top view of the foot wrap 1 in place on a human foot.
Figure 4:
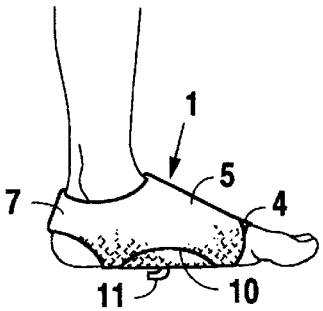
FIG. 4 shows a side view of the foot wrap 1 in place on a human foot.
Figure 5:
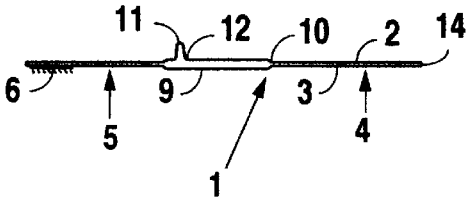
FIG. 5 shows a cross section of the foot wrap 1 sectioned along plane "A—A" shown in FIG. 2.

Referring to FIGS. 1–6, a first embodiment of the present invention is shown in the form of foot wrap 1. In FIG. 1, foot wrap 1 is shown open (i.e., laid out flat), with the outer surface of foot wrap 1 facing the viewer. FIG. 2 is a view from the opposite side showing the inner surface of foot wrap 1. FIG. 5 is a cross section along line "A—A" of FIG. 2 and generally illustrates the construction of the foot wrap. The foot wrap 1 is generally formed of two sheets 2 and 3 which are bonded together to form a bladder 9 with tabs 4, 5 and 7 extending away from the bladder 9. Foot wrap 1 also includes a fluid inlet 11 (also referred to as "fitting 11") for inflating and deflating the bladder 9, as well as fasteners 6 and 8 for releasably securing the wrap 1 on a foot (designated as foot 100 in the drawings). To the extent any of these basic components are not otherwise readily available through numerous manufacturers, they can be obtained or located through Kinetic Concepts, Inc. in San Antonio, Tex.

Referring primarily to FIG. 5, sheet 2 is preferably cut from a robust, non-stretch fabric. The outer surface of sheet 2 (i.e., the surface facing away from sheet 3) has loops like those found on Velcro loop material, which are compatible to releasably engage Velcro book material. The interior surface of sheet 2 (i.e., the surface facing toward sheet 3) is heat-weldable. Sheet 2, thus, is referred to as a sheet of laminated loop fabric that forms the outer sheet of wrap 1.

Preferably, although each of the sheets 2 and 3 are air impermeable, they are each also formed of vapor permeable fabric. Their vapor-permeability serves to enable moisture from foot 100 to evaporate despite the foot wrap 1. This is especially preferable for sheet 3 so that perspiration adjacent bladder 9 can be evacuted from the site by the fluid that inflates and deflates bladder 9. The removal of surface moisture forming on the patient's skin beneath the foot wrap is beneficial since it helps promote the maintenance and healing of skin conditions, especially during protracted use.

Figure 6:
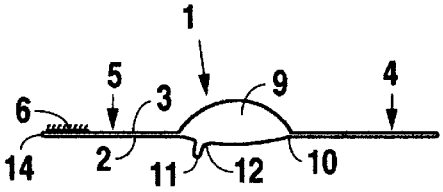
FIG. 6 shows the same cross-section as in FIG. 5, except that bladder 9 is shown inflated in FIG. 6.
Figure 7:
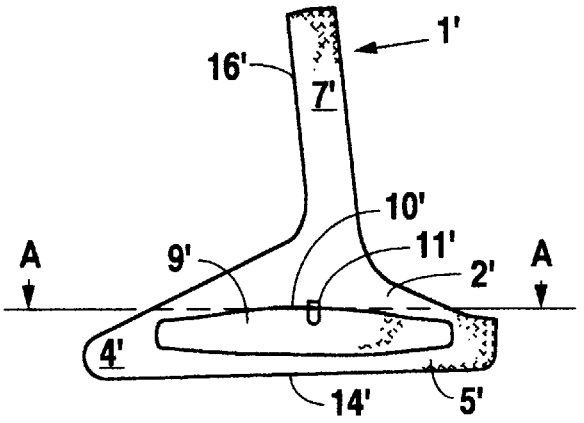
FIG. 7 shows a second embodiment of the present invention in the form of a foot wrap 1', laid out flat in the same manner as foot wrap 1 in FIG. 1.
Figure 8:
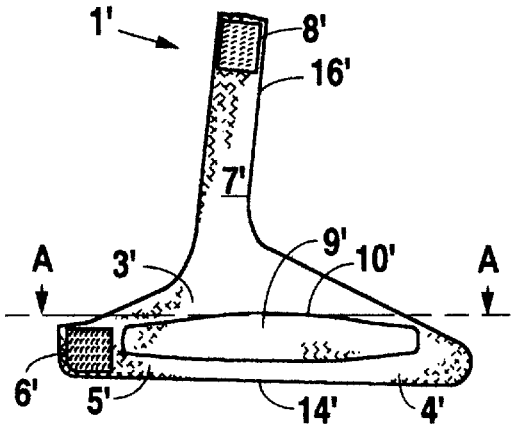
FIG. 8 shows a view of the inner surface of the foot wrap 1' laid flat.
Figure 9:
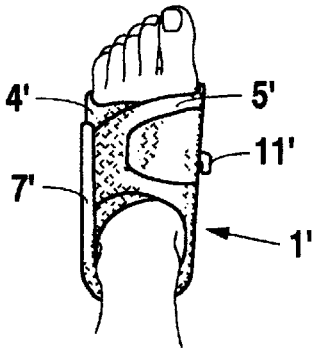
FIG. 9 shows a top view of the foot wrap 1' in place on a human foot.
Figure 10:
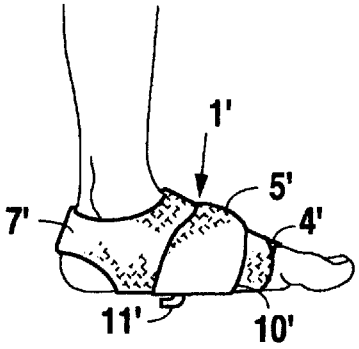
FIG. 10 shows a side view of the foot wrap 1' in place on a human foot.

Sheet 3 is preferably cut from the same or a similar pattern as sheet 2, so that it matches neatly with sheet 2. The manufacturing process may be simplified by first joining the sheets 2 and 3 together (as described elsewhere herein) and then cutting the border of each sheet. The cutting process may also be simplified by welding the two sheets together while simultaneously beat-cutting the border of the fabric with the same die (as is common in the art), although this process is not always successful due to the compositions of the sheets. Sheet 3 is preferably also a semi-elastic fabric, so that it expands more than outer sheet 2 when bladder 9 is inflated (as shown in FIG. 6). The inner surface of sheet 3 (i.e., the surface facing toward sheet 2) is heat-weldable to enable bonding with the inner surface of sheet 2. It is important that the outer surface of sheet 3 (i.e., the surface facing away from sheet 2) is a soft and comfortable against the skin, as that surface is likely to be in contact with the patient's skin during use. In the preferred embodiment, sheet 3 is a laminated lycra material that meets the foregoing characteristics. As will be evident from this description to those of ordinary skill in the art. Other fabrics such as less costly nylon fabrics may be substituted with related sacrifices of various aspects of this invention.

Bladder 9 is formed between sheet 2 and sheet 3 by weld line 10. Weld line 10 is a closed line so that it completely surrounds and thereby defines a closed area on each of sheets 2 and 3. Thus, bladder 9 is a sealed bladder, the only inlet or outlet of which is provided by a tubular connector fitting 11 (described below). Bladder 9 is provided in foot wrap 1 to apply pressure on the foot 100 when the wrap 1 is secured on the foot 100 and the bladder is inflated. Bladder 9 is of minimum size and volume consistent with its object of exerting pumping pressure on the foot and therefore requires a minimum volume of pressurized air per pulse. It is seen that although the bladder 9 occupies only the sole area of the foot 100, pressure and bladder expansion there causes the fabric enclosure around the foot to tighten and exert a compression force all around the arch region 101 of the foot 100. Bladder 1 is primarily intended for pneumatic inflation, although other fluids could be substituted by those of ordinary skill in the art.

In the first embodiment bladder 1 is circular, roughly 3 to 5 inches in diameter. However, other shapes of bladders may be substituted while still employing many of the basic aspects of the invention. For instance, referring to a second embodiment as shown in FIGS. 7–10, an elongate bladder can be provided in an orientation that encircles the arch region 101 of the foot 100 when it is properly applied. The elongate bladder 9' of the second embodiment is slightly tapered (or may be pointed) near its opposite ends. The length of bladder 9' is sufficient such that its opposite ends will overlap each other when the wrap 1' is applied to a foot 100 of ordinary adult size. Other features of the second embodiment are substantially identical to like-numbered features of the first embodiment, and the corresponding descriptions of the first embodiment should be equally applicable to the second embodiment.

Referring again to the first embodiment, especially as shown in FIGS. 5 and 6, fitting 11 is a tubular fluid connector having an elbow form to reduce its height profile. Its elbow shape also enables connection of a fluid hose (not shown) to the fitting 11 and helps minimize the possibility of kinking such a hose during use. Conventional hose connectors may be incorporated in the outermost end of fitting 11 to enable connection of such a hose, although a properly sized hosed can also be connected merely by a friction fit with fitting 11. Fitting 11 is formed of a compatible heat-weldable material and has a base flange 12. This fitting is inserted through a hole punched in fabric sheet 2 so that flange 12 contacts the heat-weldable inner surface of fabric sheet 2 and is then welded fluid-tight to complete the bladder.

As mentioned, bladder 9 is formed in a main portion of foot wrap 1, and tabs (or "extensions") 4, 5 and 7 extend generally away from the bladder 9. Tab 5 and a larger and longer extension 4 lie on opposite sides of the main portion that includes bladder 9, extending along the line "A—A". Extension of tab 7 lies substantially perpendicular to line "A—A" and is considerably longer and narrower than tab 5. In other preferred embodiments (no shown), the tab 7 is more perpendicular than pictured in any of FIGS. 1–10. Edge 16 of tab 7 as shown in FIG. 1 is aligned approximately tangent to the right hand (right in FIG. 1) extremity of bladder 9. Hook patch 6 is sewn of welded at or near the distal end of tab 5 and is located, as shown in FIG. 2, on the outer surface of inner sheet 3. The distal end of tab 7 is covered by a Velcro patch 8 in the same manner as tab 5 is covered with patch 6.

The outer perimeter 14 of the entire foot wrap 1 is RF-welded to form a single composite sheet with the single tubular fitting 11 mounted therein. This preferred embodiment weighs less than 6 ounces and is approximately 38 centimeters in the direction of line "A—A" of FIG. 1 by 39½ centimeters in the perpendicular direction, which is in striking contrast to the large and complex foot wraps heretofore employed for this service. Other forms of connecting the sheets may be used, such as by stitching, although commensurate sacrifices of inventive aspects will be associated with such a change.

Foot wrap 1 also stands out for its ease and simplicity of use. Place the foot wrap in the flat position shown in FIG. 2, inner sheet 3 in contact with the foot, heel parallel to tab 7 and extending in the same direction as tab 7, wrap tab 4 around the arch of the foot and then wrap tab 5 over tab 4 where they overlap above the arch. Adjust the tightness of the fit to the degree desired and press the tip of tab 5 onto the outer surface of tab 4. This will enclose the foot in a closed hoop of fabric. The relative length of tabs 4 and 5 are not fixed but must meet the requirement of overlapping sufficiently to form a secure fastening when wrapped around a foot. Thus tab 4 may be shorter than tab 5, although the general proportion illustrated in FIGS. 1 and 2 are preferred. To maintain the positioning of the bladder just established, draw tab 7 around the back of the foot (or heel) and pull it snug. Hooked tip 8 is then pressed onto the outer surface of foot wrap 1 where it overlaps on the side of the foot. The foot wrap is now locked in position until the fastenings are peeled open for removal of the foot wrap. This procedure can be accomplished in a few seconds, and removal requires only pulling of the two tabs 5 and 7.

Position of the bladder 9 relative to the sole of the foot is easily seen and minor adjustments, if required, consist of loosening and repositioning one or both tabs 5 and 7 as necessary.

The foot wrap 1 will fit a wide range of foot sizes without change in the application technique. Feet of very small persons may be fitted through the use of firm padding above the instep and behind the heel to stimulate a larger foot while allowing the bladder to act directly against the sole of the foot, as desired.

The foot wrap may be manufactured in both right and left handed form, if desired, although it is also envisioned within the scope of this invention that a single foot wrap can be interchangeable for both left and right feet.

An additional feature of the small, light foot wrap is that air can enter between the foot and the foot wrap from both the front and rear areas where the foot wrap wraps onto the foot. During the deflated phase of pumping, the fit is quite loose and air can easily diffuse the approximately 3 inch distance required to completely cover the area of skin beneath said foot wrap.

The soft inner surface of foot wrap 1, which is also the outer surface of sheet 3, may be covered with a springy, open pile or other lining which promotes the entrance of air into the area between said foot wrap and the foot during the decompression phase. An alternative embodiment of the invention may use a nonvapor permeable sheet 3 having an outer surface with such air movement promoting characteristics.

This small, lightweight, inexpensive foot wrap fills an important need in modern medicine and fulfills all the objects set forth for the invention.

The foregoing preferred embodiments are but examples of the present invention. It should be noted that many modifications, variations, substitutions, equivalents, and alterations will be possible while still facing within the scope of this invention, as defined by the appended claims and as will evident from the foregoing and following to those of ordinary skill in the art.

I claim:

1. A medical device adapted for use with cyclical application of fluid pressure to apply said pressure to a human foot, comprising:

an interior, elastic fabric sheet of vapor permeable composition for engaging a human foot;

a non-extensible exterior flexible fabric sheet consisting essentially of a hook-type connector compatible base material with a heat-weldable laminate applied to an inner surface of the connector compatible base material;

the interior sheet having an elastic base material with a heat-weldable laminate applied to an inner surface of the elastic base material;

The exterior sheet being heat-welded to the interior sheet in a manner forming a one-piece foot wrap having:

an integral inflatable bladder formed between the inner surfaces of the interior and exterior sheets, a first tab for releasably securing the inflatable bladder to a human foot by wrapping around the arch, an elongate second tab for releasably securing the foot wrap to a human foot by wrapping around the heel, the second tab being generally perpendicular to the first tab when said foot wrap is laid flat, a third tab generally opposed to said first tab, and a main portion positioned generally between the first, second and third tabs;

a first releasable hook-type connector permanently attached to an inner surface of a distal end of the first tab, the first and third tabs having dimensions sufficient for the foot wrap to wrap completely around the arch of a human foot with the distal end of the first tab overlapping a distal end of the third tab;

a second releasable hook-type connector permanently attached to an inner surface of a distal end of the second tab, the second tab having a length dimension sufficient for the foot wrap to wrap completely around the heel of a human foot with the distal end of the second tab overlapping the main portion; and a tubular fluid connector opening into the integral inflatable bladder and suitable for connecting the integral inflatable bladder in fluid communication with a source of pressurized fluid for inflating said bladder.

2. The device of claim 1 wherein:

the size and shape of the first, exterior flexible fabric sheet and the second, interior flexible fabric sheet are the same.

3. The device of claim 2 wherein:

the perimeters of the interior and exterior flexible fabric sheets are welded together.

4. The device of claim 1 wherein:

the integral inflatable bladder occupies an area near the center of the main portion.

* * * * *